United States Patent [19]

Saxinger et al.

[11] 4,312,503

[45] Jan. 26, 1982

[54] SPRING-LOADED FRICTION RETARD SEPARATOR

[75] Inventors: Allan L. Saxinger, Denton; Clayton M. Haigh; Barry C. Kockler, both of Lewisville, all of Tex.

[73] Assignee: Xerox Corporation, Stamford, Conn.

[21] Appl. No.: 153,281

[22] Filed: May 27, 1980

[51] Int. Cl.[3] ..... B65H 3/04; B65H 3/52

[52] U.S. Cl. ..... 271/34; 271/124

[58] Field of Search ..... 271/34, 35, 121, 124, 271/125

[56] References Cited

U.S. PATENT DOCUMENTS

| | | | |
|---|---|---|---|
| 3,260,521 | 7/1966 | Moxness | 271/121 X |
| 3,768,803 | 10/1973 | Stange | 271/34 |
| 3,831,928 | 8/1974 | Davis | 271/35 |
| 3,941,373 | 3/1976 | Stange | 271/34 X |
| 3,966,189 | 6/1976 | Taylor et al. | 271/34 |
| 3,988,017 | 10/1976 | Kyhl | 271/34 X |
| 4,074,902 | 2/1978 | Bradbury | 271/34 |

*Primary Examiner*—Bruce H. Stoner, Jr.

[57] ABSTRACT

Sheet feeding and separating apparatus adapted to separate a single sheet from a stack of sheets and forward the separate sheet away from the stack for subsequent processing. The apparatus includes a feed belt disposed adjacent the stack for contact with the top sheet to separate the sheet therefrom. A retard shoe is spring biased into engagement with the feed belt. Actuation of the feed belt and engagement of the retard shoe with the sheets provide a rotating and locking relation with the mounting member of the retard shoe thereby preventing passage of multiple sheets by the feed belt but allowing the fed sheet to be pulled from the apparatus by a low value of pull force.

4 Claims, 6 Drawing Figures

SPRING-LOADED FRICTION RETARD SEPARATOR

The invention relates in general to the feeding of sheet material and, more particularly, to improved sheet separating apparatus for reliably separating sheet material fed from a superimposed stack.

The advent of programmable printing machines, such as automatic typewriters in word processing systems, has been very popular among businesses because of the speed and accuracy with which documents may be prepared, and for some printing operations the system may operate without an operator in attendance. The result of the popularity of the word processing systems has been the creation of a need for more rapid and reliable means of automatically feeding paper to the printers of the systems. Of course, there has always been a need for rapid and reliable means of automatically feeding paper in and to large high-speed printers, sorters, collators, reproduction machines, etc. A sheet misfed or multifed sheets usually seriously impair the operation of the machine and/or system.

Apparatus and methods for separating sheet material from a stack and serially feeding discrete pieces of sheet material to a machine are known in the art. As disclosed in U.S. Pat. No. 3,260,521, a drive roller is rotatably supported so that the drive roller is engaged by the leading edge of the outside article in the stack under the force of a spring forcing the stack in the direction of the drive roller. A blade-like stop abuts the roller as a barrier to the passage of sheets from the stack with the blade-like stop being forced against the drive roller by spring means. The abutting edge of the blade-like stop is beveled to provide an inclined surface facing the stack. The sheet of paper will strike the incline, force the stop away from the drive roller and be fed between the stop and the drive roller. Multifeeds are minimized by using a heavy spring to force the blade-like stop against the drive roller together with provision of a large force to rotate the drive roller.

U.S. Pat. No. 3,941,373 discloses a feed belt for feeding sheets from a stack. A low-friction feed gate is disposed adjacent the front edge of the stack and is spring biased into engagement with the feed belt. The gate acts to maintain the forward edge of the stack in alignment and prevent the passage of more than one sheet at a time between the gate edge and the feed belt. Again, multifeeds are minimized by using a heavy spring to force the gate against the feed belt while providing a large force to drive the feed belt.

U.S. Pat. No. 3,768,803 discloses a separator in which a feed belt is supported for movement about a pair of pulleys. A curved retard means is stationarily positioned against a section of the belt between the pulleys to form a sheet queuing throat. The feed belt contacts the stack near the edge, and the throat acts to queue or align the sheets for advancement into a sheet handling system. In this system, only the topmost sheet is fed through the separator. However, adjacent sheets are shingled in the throat formed between the belt and the stationary retard pad.

In all these prior art sheet-feed apparatus, the amount of force available to pull the sheet past the retard mechanism and separate a single sheet from the stack has not been a concern or a problem. When a sheet feeder is employed in conjunction with a conventional printer in an automatic typewriter, the amount of force available to pull the sheet material from the sheet-feed apparatus and the retard mechanism may be of concern and of prime importance because the amount of force is normally low and of limited amount. This is particularly true of low-cost printers and some printers, which are already in the marketplace. Reliability of proper paper feed to the printer during automatic printing is a high priority, espeically when the printing is occurring automatically by an unattended machine. Normally the platen of the automatic printer provides the force required to pull the sheet of paper from the retard mechanism in the sheet feeder, and the platen force available for this function is limited in present-day printers.

The invention as claimed is intended to provide a remedy for unreliable paper feed, e.g., misfeed or multifeed, to an automatic printer when the available force supplied by the platen and feed rollers of the automatic printer is limited.

The invention provides reliable paper feeding to the automatic printer thereby increasing the throughput of the system by reducing delays because of paper jams caused by improperly fed sheets and the absence of paper caused by misfeeds. Available printers need not be modified to increase the torque available to the platen drive system. One advantage offered by the present invention is the low amount of force required to pull a sheet of material through the friction retard separator.

Although the invention is appicable to any sheet-feed environment utilizing low value of pull force, it has been found particularly useful in the environment of a paper feeder for a printer system having limited amount of platen pull force; therefore, without limiting the bounds of the invention, the invention will be described in this environment.

One means for carrying out the invention is described in detail below with reference to the drawing, which illustrates only one specific embodiment, in which.

Figure 1:
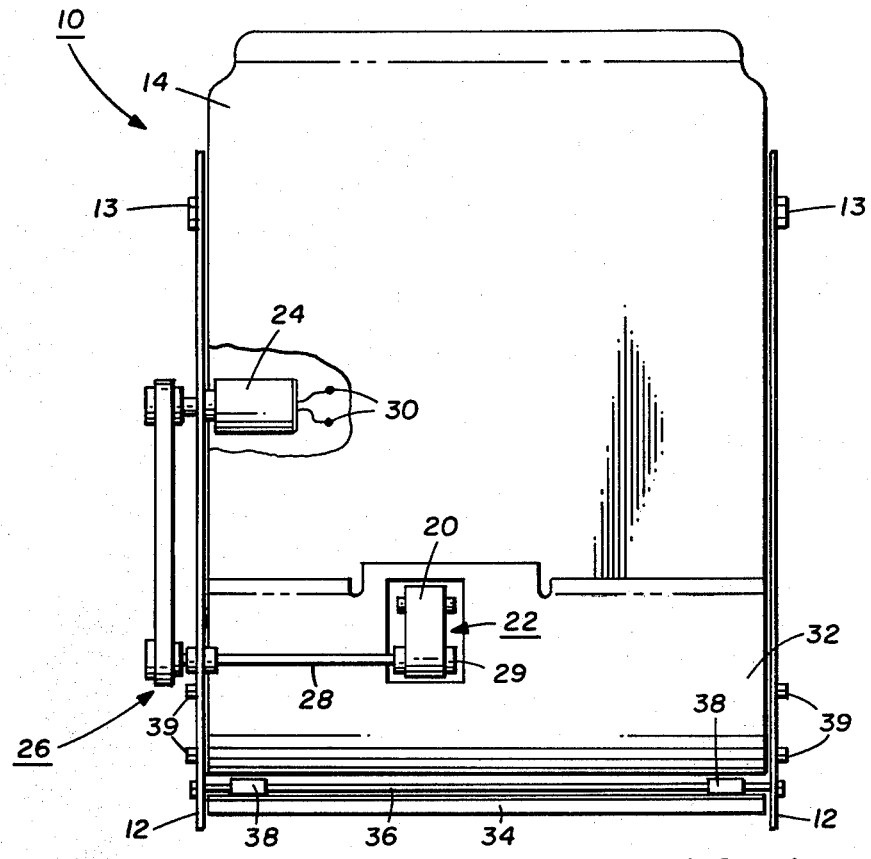
FIG. 1 is a simplified top view of a sheet-feed apparatus embodying the present invention.
Figure 2:
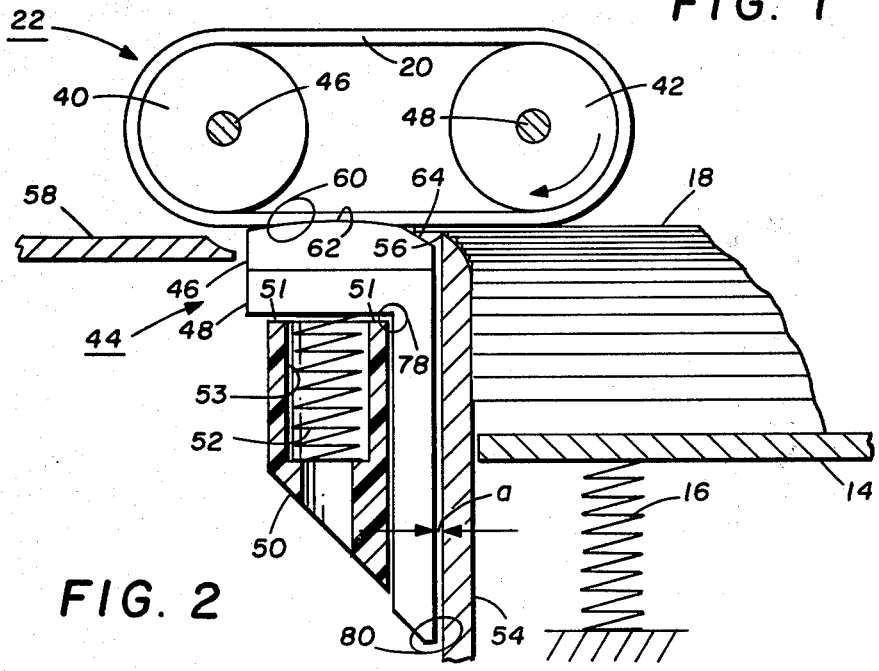
FIG. 2 is a simplified side view of the sheet feeding and separating apparatus of the present invention.

Referring now to FIG. 1, a simplified view of a sheet-feed apparatus 10 embodying the present invention is illustrated. Mounted to frame 12 by pivot means 13 is an input tray 14 for receiving a stack of sheet material therein. As seen in FIG. 2, spring means 16 forces the stack of sheet material or paper sheets 18 against a sheet feeding and separating belt 20 of paper-feed assembly 22. Sheet 18 could be a single sheet or multiple sheets. The sheet feeding and separating belt 20 is driven by stepper drive motor 24 through the pulley-belt assembly 26, shaft 28 and one-way clutch 29. Stepper drive motor 24 is controlled via signals applied to terminals 30. There are two guide plates 32 and 34; guide plate 32 is stationary and guide plate 34 is pivotable. Guide plates 32 and 34 tend to guide the sheet material 18 after it leaves the paper-feed assembly 22 on its path of travel to the printer (not shown). The top edge of guide plate 34 is removably attached to rod 36 by spring clips 38 and is pivoted at its lower portion by pivot means (not shown). This means of mounting plate 34 allows the plate 34 to pivot away from the sheet-feed apparatus 10 and guide plate 32 to provide for clearing of any paper jams, etc. Guide plate 32 is removably attached to frame 12 by fasteners 39.

Referring now to FIG. 2, the paper-feed assembly 22 includes a sheet feeding and separating belt 20 mounted for movement about rollers 40 and 42 together with spring-loaded friction retard separator 44. Rollers 40 and 42 rotate about shafts 46 and 48, respectively, in a clockwise direction as does the sheet feeding and separating belt 20. The spring-loaded friction retard separator 44 includes retard pad or shoe 46 attached to a generally L-shaped mounting block 48. Mounting block 48 is positioned within and guided within predetermined limits by guide 50. Compression spring 52 mounted within opening 53 in guide 50 tends to force mounting block 48 and attached retard pad 46 toward the sheet feeding and separating belt 20 such that the retard pad 46 is in contact with belt 20 and is raised from contact with top surface 51 of guide 50. Mounting block 48 is free to move up and down with respect to guide 50 and support member 54. Dimension "a" is 0.020 inch ±0.010 inch. Guide 50 is attached to support member 54 by suitable means, such as bolts or rivets (not shown). Support member 54 also functions as a front support wall for input tray 14. Upper edge 56 of support member 54 is positioned with respect to the sheet feeding and separating belt 20 to limit the number of sheets 18 that could traverse the opening therebetween. Spring 16 forces the forward edge of input tray 14 toward paper-feed assembly 22 such that the top sheet of material or paper 18 is positioned in contact with the sheet feeding and separating belt 20. Support member 58 supports the sheet 18 as it exits the paper-feed assembly 22.

The sheet feeding and separating belt 20 is formed from isoprene stretch material. The isoprene stretch material has a high coefficient of friction in the order of 2 or greater. The retard pad or shoe 46 is formed from silicone rubber, which has a lower coefficient of friction, i.e., 1.5, than the isoprene stretch mateial. Sheet material 18 has a coefficient of friction, which is less than either the isoprene stretch material or the silicone rubber. Mounting block 48 is machined from aluminum, and guide 50 is molded from glass-reinforced polycarbonate. Guide 50 may also be machined from aluminum, which works even better than the glass-reinforced polycarbonate but is more expensive to fabricate. Compression spring 52 is available from Associated Spring Corporation as part No. CO 300-022-0880S. During normal feed operation when one sheet 18 only is being fed, the force of spring 52 is essentially equal to the locking force (to be discussed below) supplied by mounting block 48 plus the force of gravity as applied to mounting block 48.

The relative position of the sheet feeding and separating belt 20 and the retard pad or shoe 46 is important. The retard pad or shoe 46 is positioned at a location near the roller 40 such that when a normal force is applied to the sheet feeding and separating belt 20 in the area 60 of the back portion of the retard pad or shoe 46 by sheet material 18 being fed therebetween, the sheet feeding and separating belt 20 is compressed thereby limiting the deflection of belt 20 upward between rollers 40 and 42.

Figure 3:
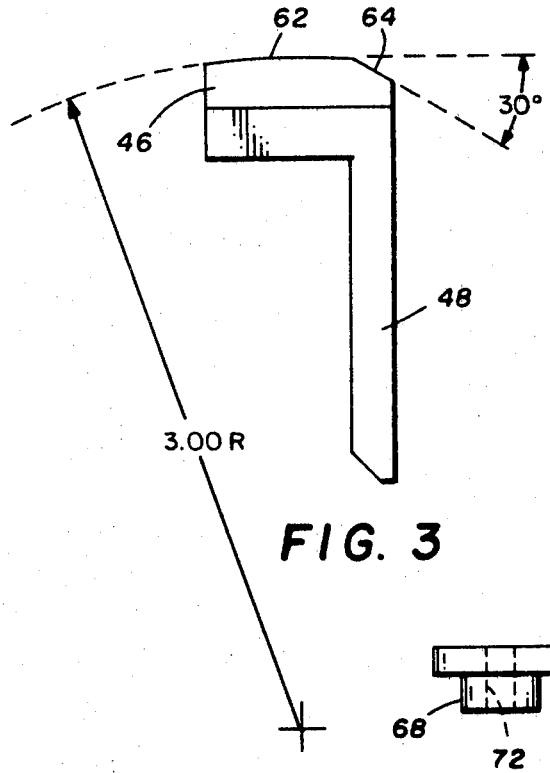
FIG. 3 is a simplified side view showing the mounting block.
Figure 4:
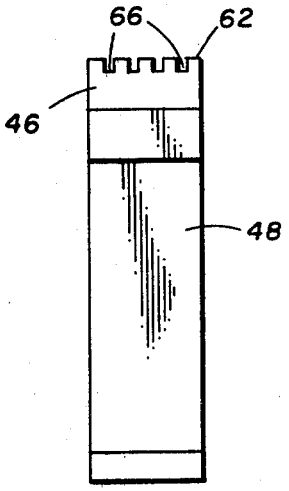
FIG. 4 is a simplified rear view showing the mounting block.

Referring now to FIGS. 3 and 4, a side and rear view of the mounting block 48 and the retard pad or shoe 46 are shown. The outer curved surface 62 of the retard pad or shoe 46 is formed on a three inch radius. Beveled face 64 is generally formed at a 30 degree angle from surface 62. Grooves 66 are formed in surface 62.

Figure 5:
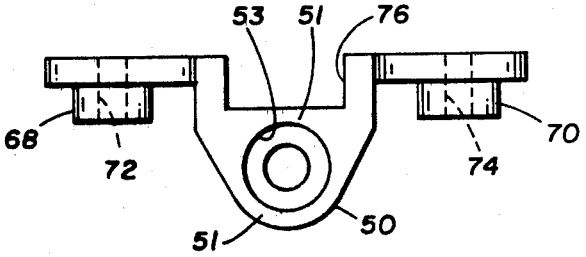
FIG. 5 is a simplified top view showing the guide.
Figure 6:
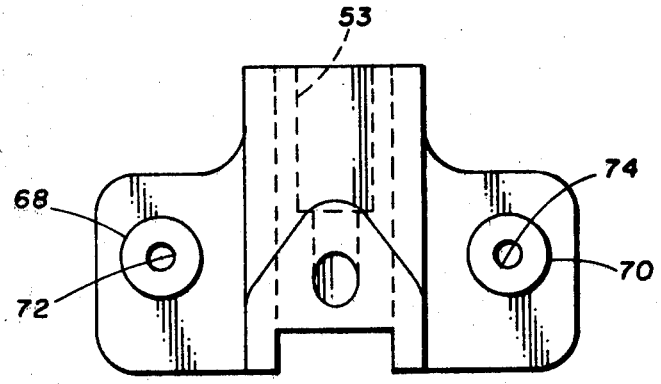
FIG. 6 is a simplified rear view showing the guide.

Referring to FIGS. 5 and 6, a top and rear view of guide 50 is shown. Lugs 68 and 70 through which openings 72 and 74 are formed, respectively, provide mounting means, together with appropriate fasteners, to mount guide 50 to support member 54 (FIG. 2). Spring 52 (see FIG. 2) is mounted within opening 53. The vertical portion of mounting block 48 is positioned within cutout 76.

In operation of the specific embodiment employing the present invention and with reference to FIG. 2, paper feed is initiated by rotation of the sheet feeding and separating belt 20 in a clockwise direction. Since the sheet feeding and separating belt 20 is in contact with sheets 18 and retard shoe 46, the movement of belt 20 causes two things to happen essentially at the same time. Curved surface 62 of the retard shoe 46 is forced to the left causing a rotation or cocking of mounting block 48 with respect to guide 50 and support member 54. Moment point 78 between mounting block 48 and guide 50, together with contact point 80 between mounting block 48 and support member 54, provide the contact surface areas between the mounting block 48, guide 50 and support member 54. The mounting block 48 is locked or wedged in this position, and the force of spring 52, together with the frictional forces at moment point 78 and contact point 80, keeps the retard shoe 46, together with mounting block 48, from being depressed away from the sheet feeding and separating belt 20. At the same time, the moment of the sheet feeding and separating belt 20 over the stack of sheets 18 causes the outer or uppermost sheets 18 to be pulled toward the throat formed by the belt 20 and the upper edge of support member 54 and retard shoe 46. The separated sheets 18 are immediately subjected to the queuing operation of the throat area and the beveled face 64 of retard shoe 46. The queuing process relies on the fact that the coupling forces between the belt 20 and the outermost sheets 18 are greater than the coupling forces between the other sheets 18. Any underlying sheets 18 pulled along are stopped by support member 54 and beveled face 64. If multisheets 18 tried to pass through between the curved surface 62 of retard shoe 46 and belt 20, the mounting block 48 with retard shoe 46 locks even tighter (the larger the wedge of paper, the greater the locking force), and only one sheet 18 is allowed to pass through the paper-feed assembly 22. The leading edge of sheet 18 passes through the paper-feed assembly 22 and on to the platen and feed-roll assembly (not shown) of the printer. The paper-feed assembly 22 stops feeding the sheet 18 at this time even though the rear portion of sheet 18 remains between belt 20 and retard shoe 46. Because of the locking action of the invention, the force of spring 52 can be made very low, which results in a very low force being required by the platen (not shown) to pull the sheet from the paper-feed assembly 22. As the sheet 18 is being pulled from the paper-feed assembly 22, one-way clutch 29 (FIG. 1) essentially disconnects stepper drive motor 24 from the paper-feed assembly 22 to allow sheet 18 to be removed by the platen. The paper-feed assembly 22 is then started, and the next sheet is fed to the printer.

As previously noted, the location of the retard shoe 46 relative to the roller 40, together with the locking action of the mounting block 48 and attached retard shoe 46, is most important. If more than one sheet 18 is attempted to be fed past the retard shoe 46, the sheet feeding and separating belt 20 is compressed rather than deflected (with respect to the retard shoe 46). The force provided by multiple sheets 18 attempting to be fed across the retard shoe 46 increases the force of the locking mechanism thereby preventing the depression of the retard shoe 46. The net result is an infinitely adjustable retard mechanism ensuring single sheet feed with minimal force required by the platen to remove the sheet 18 from the paper-feed assembly 22.

Another advantage of the present invention is the self-adjusting feature. As the curved surface 62 of the retard shoe 46 wears out, spring 52 automatically pushes the mounting block 48 further in an upward direction such as to maintain contact between the curved surface 62 of the retard shoe 46 and the surface of the sheet feeding and separating belt 20.

Although the present invention has been described with reference to a presently preferred embodiment, it will be appreciated by those skilled in the art that various modifications, alternatives, variations, etc., may be made without departing from the spirit and scope of the invention as defined in the appended claims.

What is claimed is:

1. An apparatus for feeding and separating individual sheets from a stack of sheets comprising:

a compressible endless sheet feeding and separating belt mounted for rotational movement about spaced supports and positioned for sheet feeding engagement with said stack of sheets;

a retard member having a finitely curved frictional retard surface;

mounting and guiding means to support said retard member in a predetermined location such that said retard surface is capable of engaging said belt in a section where said belt material will be compressed upon said engagment thereby limiting belt deflection by said engagement, said mounting and guiding means being capable of allowing movement of said retard member toward or away from said belt during rotational movement of said belt and said feeding of said sheets;

biasing means adapted to bias said retard member into engagement with said belt;

said mounting means being adapted to allow said retard member to rotate about a moment point generally adjacent the upstream end of said retard member and lock in a predetermined position during roatational movement of said belt and said feeding of said sheets, the force generated by said lock and said biasing means being sufficient to provide sheet separation.

2. Apparatus as recited in claim 1 wherein said biasing means includes a spring.

3. Apparatus as recited in claim 1 wherein said feed belt is deformable and made of an elastic material.

4. Apparatus as recited in claim 1 wherein said retard member is a curved ribbed pad of resilient frictional material.

* * * * *